United States Patent [19]

Ziemianski

[11] Patent Number: 4,568,387

[45] Date of Patent: Feb. 4, 1986

[54] AUSTENITIC STAINLESS STEEL FOR LOW TEMPERATURE SERVICE

[75] Inventor: John P. Ziemianski, Avonmore, Pa.

[73] Assignee: Allegheny Ludlum Steel Corporation, Pittsburgh, Pa.

[21] Appl. No.: 627,378

[22] Filed: Jul. 3, 1984

[51] Int. Cl.[4] ..... C22C 38/58

[52] U.S. Cl. ..... 75/128 A; 75/128 N; 75/125

[58] Field of Search ..... 75/128 A, 125, 128 N; 148/38

[56] References Cited

U.S. PATENT DOCUMENTS 3,615,366 10/1971 Allen ..... 75/128 A 3,645,725 2/1972 Denhard, Jr. et al. ..... 75/128 N

*Primary Examiner*—L. Dewayne Rutledge

*Assistant Examiner*—Deborah Yee

*Attorney, Agent, or Firm*—Patrick J. Viccaro

[57] ABSTRACT

An austenitic stainless steel particularly adapted for low temperature applications and having good low temperature properties; the steel consists essentially of, in weight percent, carbon 0.03 max., manganese 6.4 to 7.5, silicon up to 1%, chromium 16 to 17.5, nickel 4 to 5.0, copper up to 1%, nitrogen 0.13 to 0.20, and balance iron. The steel is characterized by minimum properties of 17% minimum elongation, 0.025 inch lateral expansion and tensile strength of 175,000 psi at a temperature of −320° F. and an $M_{d30}$ temperature of −10° C. or lower.

5 Claims, 2 Drawing Figures

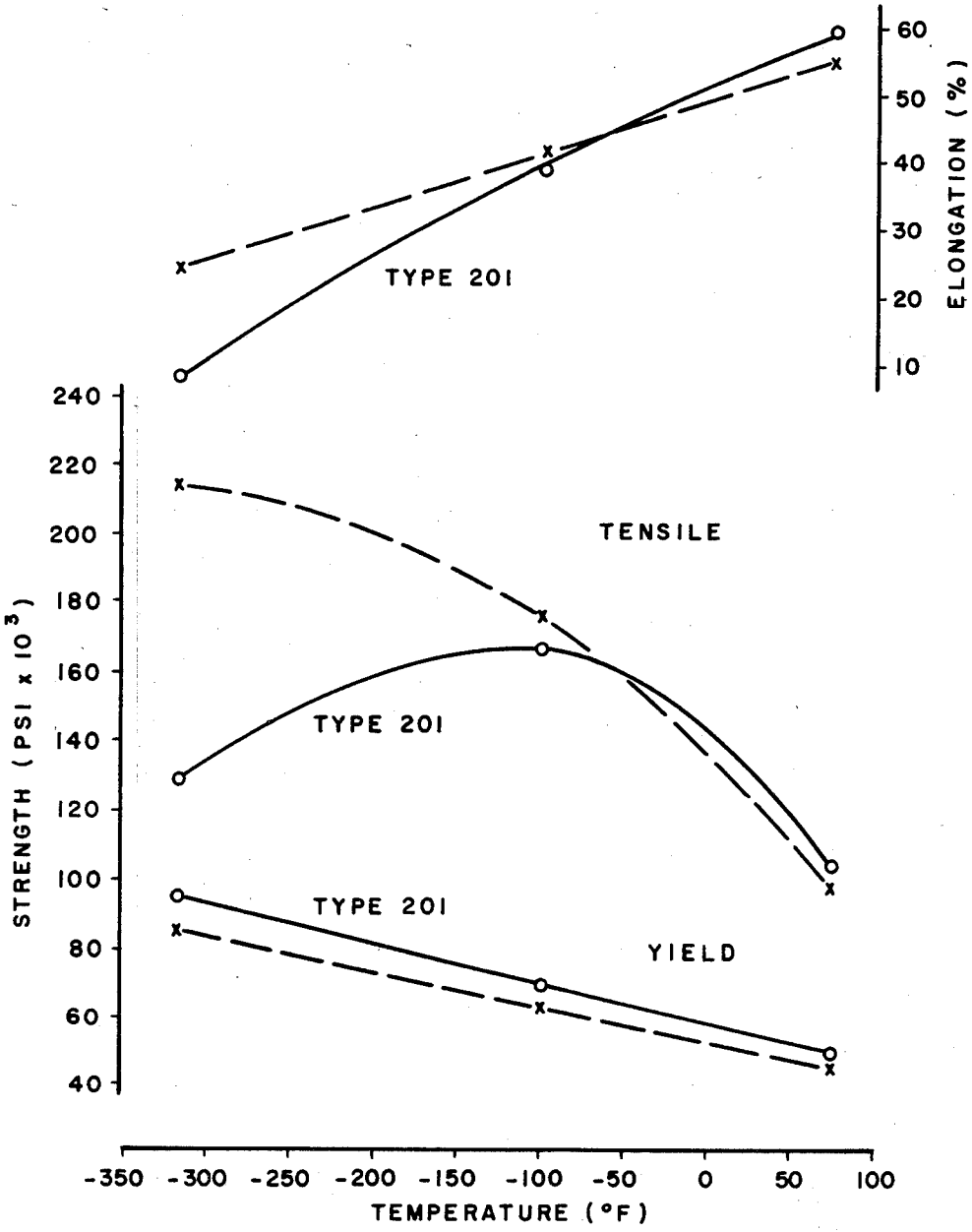
TYPE 201
ELONGATION (%)
60
50
40
30
20
10
TENSILE
TYPE 201
YIELD
TYPE 201
STRENGTH (PSI x 10³)
240
220
200
180
160
140
120
100
80
60
40
-350 -300 -250 -200 -150 -100 -50 0 50 100
TEMPERATURE (°F)

AUSTENITIC STAINLESS STEEL FOR LOW TEMPERATURE SERVICE

BACKGROUND OF THE INVENTION

This invention relates to austenitic stainless steels having improved mechanical properties at low temperature service. More particularly, the invention relates to stable austenitic Cr-Ni-Mn steels having good strength, fabricability, including welding, and suitable for low temperature service.

It is known to use austenitic stainless steel for structures used in low temperature and cryogenic applications where corrosion resistance is likewise significant. In these applications, in addition to austenitic stainless steels, it is known to use aluminum alloys or 9% nickel-containing alloy steels. The latter material has the advantage over austenitic stainless steels in that it exhibits relatively higher strengths and therefore can be used in reduced section thicknesses. The advantage of aluminum alloys are the lightweight and good strength/-weight ratios. These materials, however, are deficient in both corrosion resistance and fabricability relative to austenitic stainless steels. Applications include construction of vessels, such as pressure vessels, which include welding as an essential fabrication step for use in low temperature service. Welding of austenitic steels may result in sensitization, i.e., carbide precipitation, which is deleterious to the welded vessels when in service.

What is needed is an austenitic stainless steel having lower cost alloying elements, particularly lower nickel content which is relatively expensive, but exhibiting mechanical strength and low temperature properties comparable to higher nickel-containing alloys.

It is, accordingly, a primary object of the present invention to provide an austenitic stainless steel having high room temperature strength with good low temperature properties, particularly strength and fabricability, along with corrosion resistance and resistance to sensitization to permit fabrication as by welding.

This and other objects of the invention, as well as a more complete understanding thereof, may be obtained from the following description and specific examples.

SUMMARY OF THE INVENTION

In accordance with the present invention, an austenitic stainless steel is provided having good low temperature properties of austenitic stability, elongation and strength. The compositionally-balanced steel consists essentially of 0.03% carbon max., 6.4 to 7.5% manganese, up to 1.0% silicon, 16 to 17.5% chromium, 4.0 to 5.0% nickel, up to 1.0% copper, 0.13 to 0.20% nitrogen, and the balance iron. The steel is characterized by austenitic stability, high room temperature strength, minimized sensitization to welding, and high strength and ductility at low temperatures.

BRIEF DESCRIPTION OF THE FIGURE

The FIGURE is a graphical comparison of mechanical properties at low temperatures of the alloys of the present invention and a prior art alloy.

DETAILED DESCRIPTION OF THE PREFERRED EMBODIMENTS

The austenitic steel of the present invention is characterized by good strength and toughness at temperatures below −50° F. (−45.6° C.), particularly below −100° F. (−73.3° C.), and by fabricability, specifically resistance to sensitization, to permit welding during fabrication. The steel is compositionally balanced by restricting and controlling the austenitizing elements to achieve good minimum room temperature strength levels while maintaining sufficient austenitic stability to achieve good low temperature properties. The steel is characterized by high room temperature strength of a minimum of 45,000 psi yield strength (Y.S.) and 95,000 psi tensile strength (T.S.) and by minimum elongation and tensile strength of 17% and 175,000 psi, respectively, at a temperature of −320° F. (−195.5° C.) and an $M_{d30}$ temperature of −10° C. or lower.

Austenite stability may be defined in terms of the $M_d$ temperature which minimizes the transformation of martensite upon deformation at low temperatures. The martensite formed is of a composition to provide good toughness and formability as exhibited by the Charpy V-notch impact results and a minimum of 0.025 inch (.635 mm) lateral expansion at temperatures as low as −320° F. The austenitic stability as described by $M_{d30}$ is the temperature at which 50% martensite is formed at a true strain of 0.30. An equation for austenitic stability may be expressed as follows:

$$M_{d30}=413-462(\%C+\%N)-9.2(\%Si)-8.1(\%Mn)-13.7(\%Cr)-9.5(\%Ni)-17.1(\%Cu)-18.5(\%Mo)$$

The equation describes the relative effects of each of the alloying elements. As defined by the equation, lower $M_d$ temperatures (in °C.), indicate better austenitic stability.

As used herein, all composition percentages are percent by weight.

The chromium in the steel contributes to the general corrosion and oxidation resistance of the alloy. The chromium content of 16 to 17.5% assures the degree of corrosion resistance required for the applications to which the present invention is particularly well suited. Chromium preferably ranges from about 16.4 to 17.1% to also assure austenitic stability.

The silicon content may range up to 1%, and preferably ranges from 0.2 to 0.7%. Silicon provides for general oxidation resistance and aids in fluidity during welding.

The copper content may range up to 1% and preferably ranges from 0.35 to 0.6%. Copper provides for corrosion resistance to certain media and contributes to austenitic stability.

The manganese may be present from 6.4 to 7.5% for providing the desired levels of strength to the steel. Manganese also increases the alloy solubility for nitrogen which aids weldability. Manganese content preferably ranges from 6.4 to 7% and contributes to the austenitic stability requirements at low temperatures.

Nickel is the primary austenitizing element and enhances the impact strength, i.e., toughness of the steel of the present invention. The nickel content is maintained at relatively low levels of 4 to 5% and preferably ranges from 4 to 4.6%. Sufficient austenitic stability is achieved at such low nickel levels as a result of the composition balance of the steel of the present invention.

The nitrogen content may range from 0.13 to 0.20%, and preferably from about 0.13 to 0.17%. Nitrogen is an austenitizing element which contributes to austenitic stability. Nickel is maintained at relatively low levels with the austenitic stability being achieved by a significant nitrogen addition which is a lower cost alloying element. Nitrogen also contributes to the overall strengh of the steel, particularly yield strength at room temperature.

The balanced composition of the steel of the present invention requires at least 6.4% Mn, 4.0% Ni and 0.13% N in order to achieve the austenitic stability at low temperatures.

The steel of the present invention also has a relatively low carbon content which obviates the need for the addition of stabilizing elements or special melting techniques to minimize sensitization to permit fabrication as by welding. Carbon ranging up to 0.03% max., preferably reduces the susceptibility to harmful carbide precipitation which can occur such as during welding.

The alloy of the present invention may contain normal steelmaking impurities and residuals and the balance iron. Phosphorus is an impurity which may be present up to 0.045% max. and sulfur as an impurity may be present up to 0.015% max.

In order to more completely understand the present invention, the following examples are presented.

EXAMPLES

A series of heats were melted, cast and hot rolled in a conventional manner to produce plate of about 0.50 inch (1.27 cm) thick. The series of heats had the compositions listed in Table I.

TABLE I

| Heat No. | C | Mn | Si | Cr | Ni | Mo | Cu | N | $M_{d30}$ (°C.) |
|---|---|---|---|---|---|---|---|---|---|
| 772520 | .019 | 6.35 | .44 | 16.25 | 4.55 | .27 | .23 | .16 | 0.0° C. |
| 879750 | .028 | 6.77 | .46 | 16.68 | 4.25 | .22 | .44 | .140 | −12.72° C. |
| 879751 | .028 | 6.71 | .48 | 16.62 | 4.20 | .18 | .43 | .160 | −11.25° C. |
| 879847 | .025 | 6.67 | .45 | 16.65 | 4.29 | .20 | .45 | .167 | −14° C. |
| 881989 | .024 | 6.37 | .47 | 16.48 | 4.20 | .26 | .30 | .17 | −9.5° C. |
| 882407 | .022 | 6.27 | .42 | 16.16 | 4.16 | .24 | .47 | .16 | −1° C. |
| 888239 | .029 | 6.70 | .30 | 16.76 | 3.76 | .20 | .44 | .15 | − 3.2° C. |

The heats listed in Table I were tested to determine the mechanical properties thereof as reported in Table II. The yield and tensile properties and elongation were tested in both the transverse and longitudinal directions as indicated by the T and L, respectively. The Charpy V-notch test was used to determine the toughness as exhibited by the energy impact and lateral expansion results.

TABLE II

| Test Temp. °F. (°C.) | Heat No. | Direction | Y.S. 0.2% offset (psi) | T.S. (psi) | Elong. in 2 in. (51 mm) (%) | Energy (ft.-lb.) | Lateral Expansion (in.) |
|---|---|---|---|---|---|---|---|
| 70 (21) | 772520 | T | 49,000 | 106,000 | 63 | | |
| | | T | 51,400 | 107,000 | 61 | | |
| | 879750 | L | 46,800 | 99,800 | 54 | | |
| | | T | 46,400 | 99,300 | 56 | 208 | .085 |
| | | T | | | | 184 | .088 |
| | 879751 | L | 51,400 | 100,800 | 53 | 290 | |
| | | T | 46,600 | 97,600 | 59 | 162 | .092 |
| | | T | | | | 154 | .087 |
| | 879847 | L | 49,800 | 96,800 | 57 | — | |
| | | T | 49,800 | 97,100 | 56.5 | 186 | .084 |
| | | T | | | | 172 | .087 |
| | 881989 | T | 51,000 | 103,000 | 65 | | |
| | | T | 47,800 | 101,000 | 65 | | |
| | 882407 | L | 56,700 | 109,100 | 52 | | |
| | | T | 55,400 | 110,300 | 50 | | |
| | | L | 55,300 | 109,000 | 53 | | |
| | | T | 56,200 | 108,300 | 50 | | |
| | 888239 | L | 47,400 | 102,000 | 54 | 295 | |
| | | T | 45,600 | 104,100 | 57 | 228 | .071 |
| | | L | 50,900 | 104,500 | 56 | 237 | |
| | | T | 47,200 | 103,900 | 55.5 | 213 | .075 |
| −100 (−73.3) | 772520 | L | 66,100 | 164,500 | 34 | | |
| | | T | 75,300 | 173,800 | 40 | | |
| | | L | 73,200 | 173,400 | 41 | | |
| | | T | 74,200 | 174,100 | 42.5 | | |
| | 879750 | L | 60.700 | 180,700 | 47 | 230 | .103 |
| | | L | 62,400 | 176,900 | 48.5 | 211 | .098 |
| | | T | 63,400 | 179,200 | 42.5 | 150 | .084 |
| | | T | 61,800 | 176,000 | 45.0 | 150 | .081 |
| | 879751 | L | 69,600 | 179,700 | 50 | 201 | .093 |
| | | L | 73,000 | 181,600 | 46 | 174 | .098 |
| | | T | 68,700 | 177,300 | 47 | 134 | .080 |
| | | T | 71,700 | 176,900 | 46 | 130 | .072 |
| | 879847 | L | 69,600 | 178,900 | 50 | 208 | .095 |
| | | L | 71,000 | 177,500 | 51 | 200 | .093 |
| | | T | 72,800 | 179,200 | 47.5 | 142 | .070 |
| | | T | 70,700 | 177,700 | 50 | 138 | .078 |
| | 882407 | L | 73,800 | 188,700 | 40 | | |
| | | T | 72,500 | 191,200 | 38.5 | | |
| | | L | 74,100 | 190,800 | 41 | | |
| | | T | 72,700 | 189,200 | 40 | | |
| | 888239 | L | 62,900 | 183,300 | 43 | 205 | .100 |
| | | T | 61,300 | 183,400 | 45 | 162 | .080 |
| | | L | 64,800 | 184,200 | 45 | 228 | .102 |
| | | T | 62,200 | 181,500 | 45 | 170 | .081 |
| −320 (−195.5) | 772520 | L | 98,700 | 134,000 | 5 | | |
| | | T | 96,100 | 129,700 | 9.5 | | |

TABLE II-continued

| Test Temp. °F. (°C.) | Heat No. | Direction | Y.S. 0.2% offset (psi) | T.S. (psi) | Elong. in 2 in. (51 mm) (%) | Energy (ft.-lb.) | Lateral Expansion (in.) |
|---|---|---|---|---|---|---|---|
| | | L | 95,800 | 132,100 | 7 | | |
| | | T | 101,300 | 133,700 | 7.5 | | |
| | 879750 | L | 82,500 | 190,500 | 22 | 95 | .056 |
| | | L | 75,200 | 242,600 | 37 | 84 | .053 |
| | | L | | | | 59 | .038 |
| | | T | 75,600 | 233,900 | 31 | 61 | .038 |
| | | T | 77,800 | 210,000 | 23 | 58 | .038 |
| | | T | | | | 80 | .044 |
| | 879751 | L | 87,600 | 234,000 | 27.5 | 54 | .038 |
| | | L | 87,400 | 249,000 | 34.0 | 52 | .032 |
| | | L | | | | 56 | .035 |
| | | T | 84,800 | 200,500 | 22.5 | 56 | .034 |
| | | T | 87,600 | 244,200 | 36.0 | 68 | .041 |
| | | T | | | | 47 | .028 |
| | 879847 | L | 89,800 | 160,600 | 19 | 76 | .045 |
| | | L | 90,200 | 197,400 | 25 | 77 | .045 |
| | | L | | | | 68 | .042 |
| | | T | 92,000 | 180,700 | 20 | 65 | .038 |
| | | T | 92,400 | 197,700 | 17 | 56 | .033 |
| | | T | | | | 56 | .037 |
| | 882407 | L | 91,000 | | | | |
| | | T | 86,000 | 166,100 | 16 | | |
| | | L | 90,800 | 196,700 | 17 | | |
| | | T | 86,700 | 177,500 | 16.5 | | |
| | 888239 | L | 80,900 | 116,600 | 6.0 | 72 | .046 |
| | | T | 82,800 | 128,800 | 7.0 | 68 | .039 |
| | | L | 82,600 | 125,800 | 7.5 | 82 | .042 |
| | | T | 80,600 | 132,700 | 7.0 | 72 | .042 |

With respect to Tables I and II, the underlined values denote that they are outside of either the metallurgical composition limits of the invention or the required properties at −320° F.

The data of Table II clearly show that Heats 879750, 879751 and 879847 satisfy both the metallurgical composition limits and required properties of the steel of the present invention. Heat 772520 has insufficient Mn and Cu levels, poor austenitic stability as defined by $M_{d30}$, as well as inadequate tensile strength at −320° F. Heat 881989 also has Mn and Cu content outside the present invention and marginal austenitic stability. Mechanical properties of Heat 881989 were obtained only at 70° F. test temperature. Heat 882407 has insufficient Mn and Ni content, poor austenitic stability in terms of $M_{d30}$, marginal elongation and marginal tensile strength at −320° F. Heat 888239 composition includes low Ni and exhibits poor austenitic stability ($M_{d30}$), and poor elongation and tensile strength at −320° F.

The FIGURE graphically summarizes the compositional effects of Table I on the mechanical properties shown in Table II. The dashed line represents an average of the Heats 879750, 879751 and 879847 of the present invention for elongation, tensile strength and yield strength as a function of test temperature. The solid line represents the typical mechanical properties of Type 201 alloy. The $M_{d30}$ temperature for Type 201 alloy is about 0° C. The FIGURE clearly demonstrates the influence of austenitic stability on mechanical properties at low tempertures.

As was an object of the invention, the alloy exhibits a corrosion resistance comparable to Type 304 alloy and exhibits a 45,000 psi minimum yield strength and 95,000 psi minimum tensile strength at room temperature, while having increasing tensile strength as operational and environmental temperatures decrease below −100° F. The increasing strength is accompanied by high ductility as measured by tensile elongation, Charpy impact strength and lateral expansion, which are 17%, 50 ft-lbs. and 0.025 inch minimum, respectively. The steel is characterized by minimized sensitization to welding, high room temperature strengths, high strength and ductility at low temperatures and austenitic stability as a result of the compositional balance.

What is claimed is:

1. An austentitic stainless steel having good low temperature properties, said steel consisting essentially of, in weight percent, carbon 0.03 max., manganese 6.4 to 7.5, silicon up to 1.0, chromium 16 to 17.5, nickel 4.0 to 5.0, copper up to 1.0, nitrogen 0.13 to 0.20, residual impurities, and the balance iron, said steel being characterized by a minimum of 17% elongation and 175,000 psi tensile strength at a temperature of −320° F. and an $M_{d30}$ temperature of −10° C. or lower.

2. The steel as set forth in claim 1 including impurities of phosphorus 0.045 max. and sulfur 0.015 max.

3. The steel as set forth in claim 1 further characterized by 45,000 psi yield strength and 95,000 psi tensile strength at room temperature.

4. The steel a set forth in claim 1 characterized by a minimum property of 0.025 inch lateral expansion at a temperature of −320° F.

5. An austenitic stainless steel having good low temperture properties, said steel consisting essentially of, in weight percent, carbon 0.03 max., manganese 6.4 to 7, phosphorus 0.045 max., sulfur 0.015 max., silicon 0.2 to 0.7, chromium 16.4 to 17.1, nickel 4 to 4.6, copper 0.35 to 0.60, nitrogen 0.13 to 0.17, residual impurities, and the balance iron, said steel being characterized by minimum properties of 17% elongation, 0.025 inch lateral expansion and 175,000 psi tensile strength at a temperature of −320° F. and an $M_{d30}$ temperature of −10° C. or lower.

* * * * *